US006663322B1

(12) United States Patent
Listle

(10) Patent No.: US 6,663,322 B1
(45) Date of Patent: Dec. 16, 2003

(54) PIER SYSTEM

(76) Inventor: Jay Listle, 34 Central Ct., Tarpon Springs, FL (US) 34689

( * ) Notice: Subject to any disclaimer, the term of this patent is extended or adjusted under 35 U.S.C. 154(b) by 0 days.

(21) Appl. No.: 09/788,794

(22) Filed: Feb. 20, 2001

(51) Int. Cl.[7] ..... E02D 19/02

(52) U.S. Cl. ..... 405/239; 405/233; 405/249; 52/169.9; 52/297; 14/75

(58) Field of Search ..... 14/75, 77.3; 52/169.2, 52/169.3, 169.4, 169.9, 294, 295, 296, 297; 405/218–222, 224, 225, 229, 231–233, 236, 237, 239, 240, 244, 249, 255–257

(56) References Cited

U.S. PATENT DOCUMENTS 820,318 A * 5/1906 Schwem ..... 52/297 X
3,555,751 A * 1/1971 Thorgusen ..... 52/127.3
3,991,532 A * 11/1976 Buxbom ..... 52/297
5,355,642 A * 10/1994 Palamarz ..... 52/296 X
5,611,974 A * 3/1997 Welch et al. ..... 264/34

* cited by examiner

*Primary Examiner*—Heather Shackelford
*Assistant Examiner*—Sunil Singh
(74) *Attorney, Agent, or Firm*—Edward P. Dutkiewicz

(57) ABSTRACT

A pier system has a plurality of footers each formed with a base fabricated of concrete with a top face having a downwardly extending bore. A plurality of pilings are each formed with a hollow tubular shaft with a top region and a bottom region coupled to a footer. Each piling has a reinforcing bar with an upper region and a lower region coupled within the bore of a footer. Each piling further has a plurality of apertures formed within the upper region of each shaft. A deck has a plurality of stringers with spaced free ends located within the shafts. A supplemental quantity of concrete within each shaft couples the shafts, footers, reinforcing bars, and stringers. A plurality of planks have mechanisms that couple the planks to the stringers.

6 Claims, 7 Drawing Sheets

70
10
72
40
74
2
34
46
28
32
30
64
66
44
42
20
20
12
2
12

FIG 4A
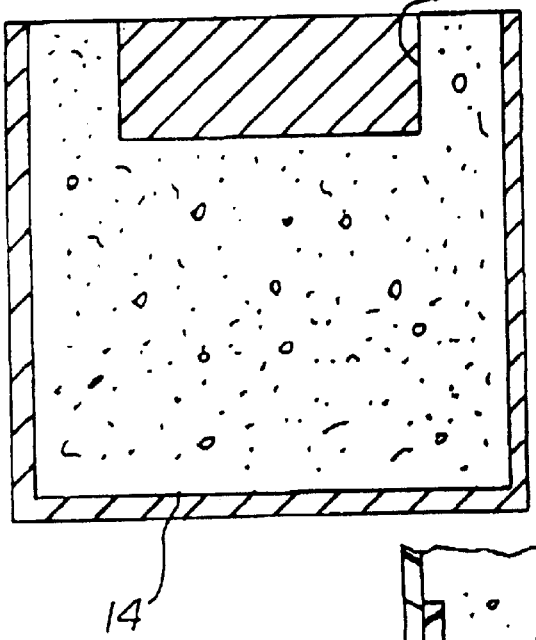
FIG 4B
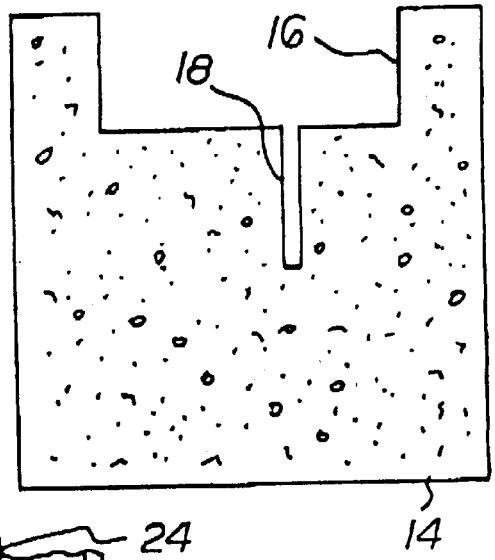
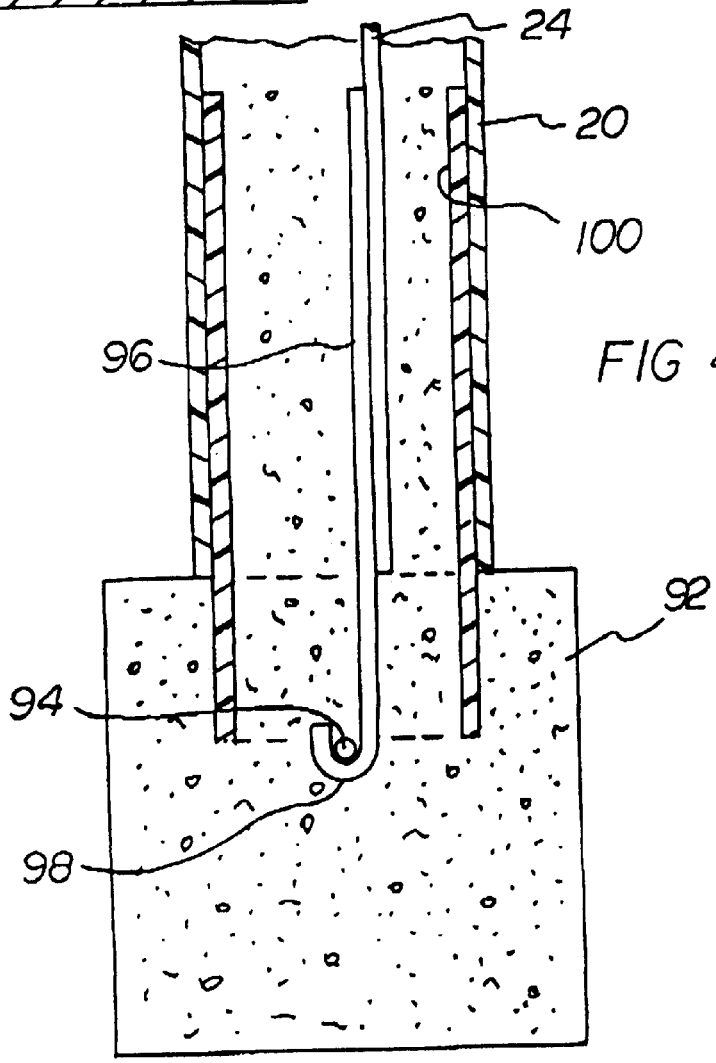
FIG 4C

FIG 5
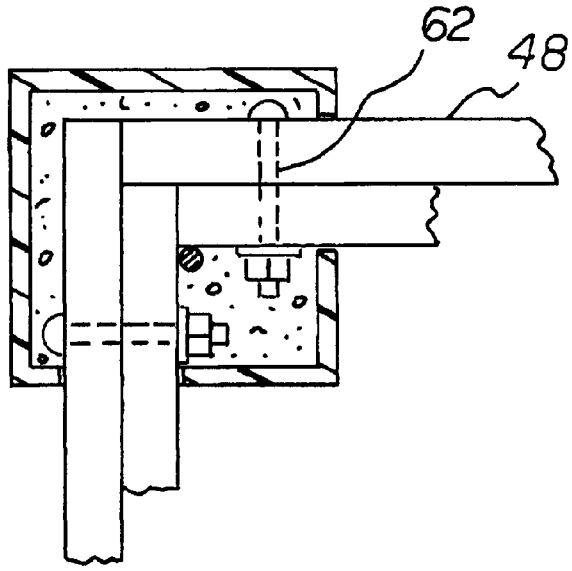
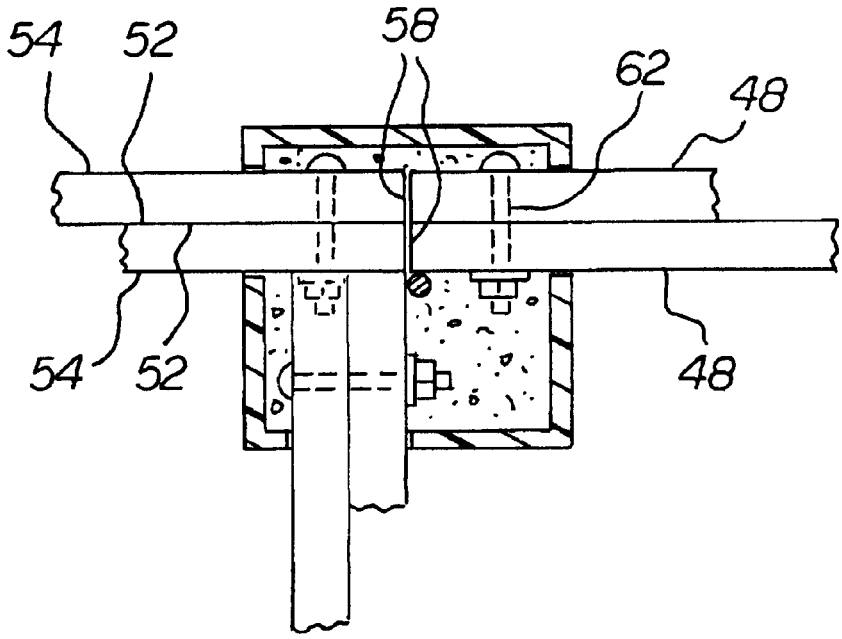
FIG 6

FIG 7
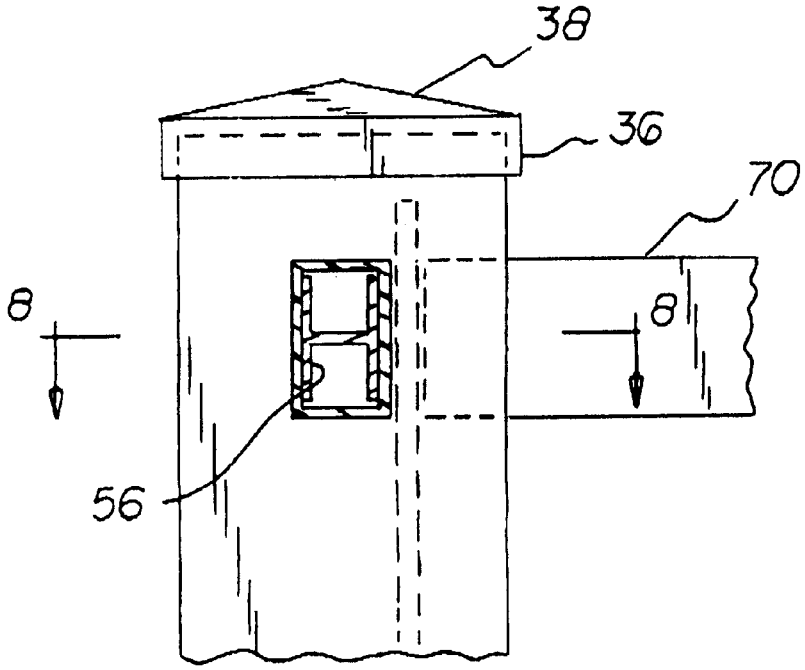
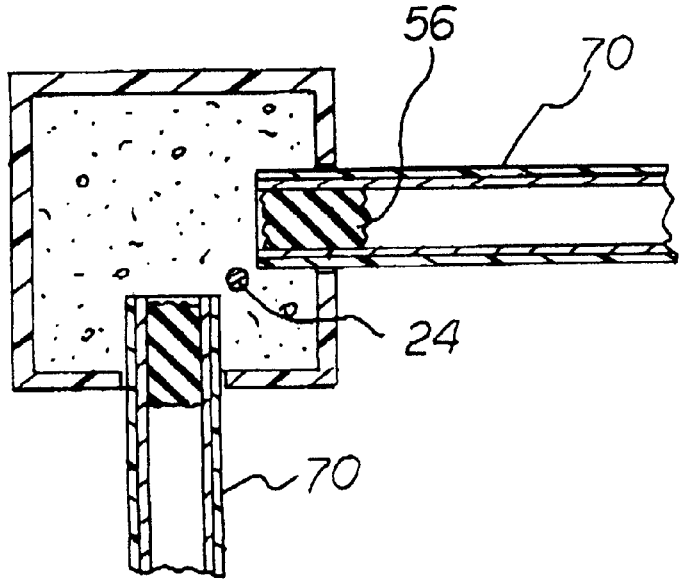
FIG 8

FIG 9
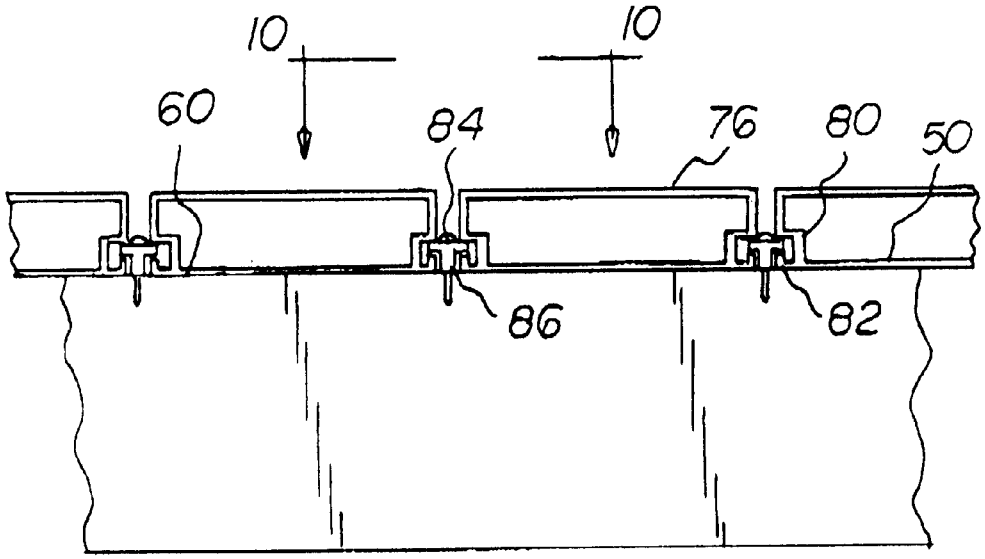
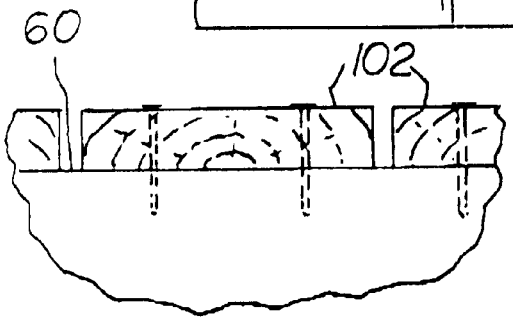
FIG 9A
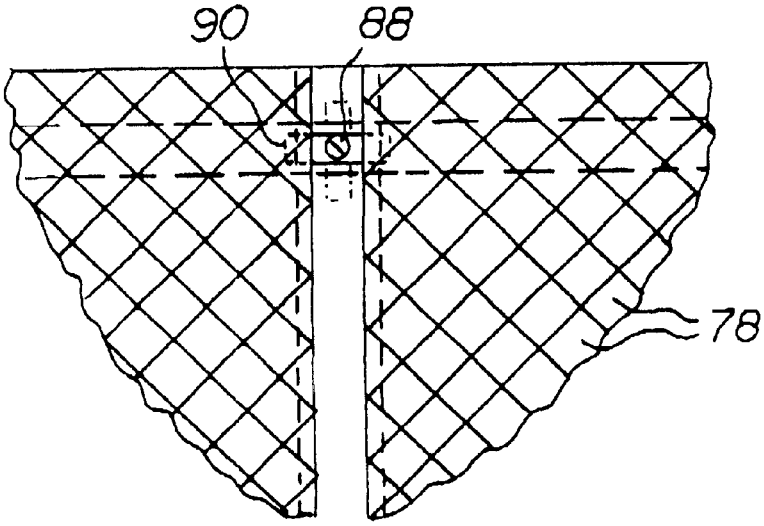
FIG 10

PIER SYSTEM

BACKGROUND OF THE INVENTION

1. Field of the Invention

The present invention relates to a pier system and more particularly pertains to providing a strong and easily assembled pier system.

2. Description of the Prior Art

The use of piers and docks and like structures of known designs and configurations is known in the prior art. More specifically, piers and docks and like structures of known designs and configurations previously devised and utilized for the purpose of fabricating piers and pilings and other structures through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 2,027,511 to Bertran discloses a method of casting a bell bottom place piling in soft sandy material. U.S. Pat. No. 2,140,111 to Newman discloses a method and apparatus for forming concrete foundation columns. U.S. Pat. No. 3,348,459 to Harvey discloses interlocking matting and coupling bar thereof. U.S. Pat. No. 3,851,485 to Steding discloses a method and apparatus for installing concrete piles. U.S. Pat. No. 4,127,002 to DeWitt discloses a method for forming a concrete piling foundation. U.S. Pat. No. 5,623,803 to Willis discloses a plastic decking and securement system and method of installation. U.S. Pat. No. 5,050,361 to Hallsten discloses deck structure. U.S. Pat. No. 5,234,288 to Bone discloses an integral combination of column and pile. U.S. Pat. No. 5,412,915 to Johnson discloses a dock plank assembly. U.S. Pat. No. 5,850,720 to Willis discloses a plastic decking and securement system and method of installation.

While these devices fulfill their respective, particular objectives and requirements, she aforementioned patents do not describe a pier system that is strong and easily assembled.

In this respect, the pier system according to the present invention substantially departs from the conventional concepts and designs of the prior art, and in doing so provides an apparatus primarily developed for the purpose of providing a strong and easily assembled pier system.

Therefore, it can be appreciated that there exists a continuing need for a new and improved pier system which is strong and easily assembled. In this regard, the present invention substantially fulfills this need.

SUMMARY OF THE INVENTION

In view of the foregoing disadvantages inherent in the known types of piers and docks and like structures of known designs and configurations now present in the prior art, the present invention provides an improved pier system. As such, the general purpose of the present invention, which will be described subsequently in greater detail, is to provide a new and improved pier system and method which has all the advantages of the prior art and none of the disadvantages.

To attain this, the present invention essentially comprises a plurality of footers. The footers are fabricated at an off site location. Each footer is formed of a base fabricated of concrete. The base has a generally cubical configuration with a top face and a square bottom face and four square side faces there between. Each top face has a rectilinear recess with a downwardly extending cylindrical bore therein. Next provided are a plurality of pilings. The pilings include corner pilings and side pilings. Each piling is formed of a hollow tubular shaft fabricated of polyvinyl chloride in a square cross sectional configuration with a top region and bottom region. Each shaft has dimensions such that the lower region is matingly received and coupled within the recess of a footer. Each piling further has a reinforcing bar with an upper region and a lower region. The upper region of the reinforcing bar extends into the upper region of the shaft. The lower region of the reinforcing bar is received and coupled within the bore of the footer. At the construction site, a quantity of a two part epoxy resin is applied within the recess to couple the shaft and reinforcing bar to the footer. Each piling further has a plurality of apertures at various heights within the upper region of the shaft. The apertures include upper apertures, lower apertures and intermediate apertures. A cap is next provided. The cap is fabricated of polyvinyl chloride. The cap is coupled to and covers the upper extent of each shaft following the pouring of concrete at the construction site. Each cap has a square bottom region with dimensions greater than the shaft. This configuration enables the cap to fit snugly around and over the shaft. The cap further has a pyramid-shaped upper portion. A deck comprises a plurality of stringers. The stringers include end stringers and side stringers and intermediate stringers. Each stringer is formed of two hollow polyvinyl chloride beams. Each beam has a rectangular cross section with a top face and a parallel bottom face. Each beam also has an inside face and a parallel outside face between the top face and bottom face. Each beam has a support rod there within with an H-shaped cross section. All of the beams have spaced free ends. Each stringer is formed of a pair of beams adjacent to each other to form a flush top support surface. Nut and bolt assemblies are located within the shafts. The nut and bolt assemblies couple together the beams of each stringer and extend through the side faces of adjacent beams. The end stringers and side stringers meet at adjacent ends within a corner piling through lower apertures at right angles with respect to each other. The side stringers meet at adjacent ends within side pilings and corner pilings through lower apertures in a linear relationship with respect to each other. The intermediate stringers extend between side pilings through lower apertures at right angles to the side stringers. The deck further includes a plurality of top rails. Each top rail is formed of a hollow rectangular polyvinyl chloride beam. A support rod is provided inside each beam of the rail. The support rod has an H-shaped cross section and is also formed of polyvinyl chloride. Each top rail is adapted to couple to two adjacent pilings through upper apertures in the piling above the stringers. The deck further includes a plurality of intermediate rails. Each intermediate rail is formed of a hollow rectangular polyvinyl chloride beam. A support rod is provided inside the beam. The support rod has an H-shaped cross section and is also formed of polyvinyl chloride. Each intermediate rail is adapted to couple two adjacent pilings through intermediate apertures in the pilings above the stringers and below the top rails. A supplemental quantity of concrete is provided. The concrete fills each shaft from the top of the epoxy resin to the top of the shaft to hold together the shafts, footers, reinforcing bars, stringers and rails. The deck further includes a plurality of planks. The planks are formed of hollow rectangular polyvinyl chloride beams. Each beam has a top face, a bottom face, a pair of side faces and a pair of opposite ends. The top face has a plurality of linear grooves in a crossing pattern. The grooves function to precipitate the drainage of water and provide a slip abating walking surface. Lateral grooves extend along the entire length of each side face. Next provided are a plurality of coupling mechanisms. Each coupling mechanism is formed of a pin with a top portion and a bottom portion. The top portion has a head adjacent thereto. The bottom portion is positioned on a stringer with a screw driven there through into a stringer. Each coupling mechanism is rotatable. The top region has a pair of enlarged peripheries extending radially therefrom. Each coupling mechanism is adapted to being driven into a stringer whereby planks can be laid there between and the coupling mechanisms rotated such that the peripheries extend into the grooves of the adjacent planks for securement purposes.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pier system which has all of the advantages of the prior art piers and docks and like structures of known designs and configurations and none of the disadvantages.

It is another object of the present invention to provide a new and improved pier system which may be easily and efficiently manufactured and marketed.

It is further object of the present invention to provide a new and improved pier system which is of durable and reliable constructions.

An even further object of the present invention is to provide a new and improved pier system which is susceptible of a low cost of manufacture with regard to both materials and labor, and which accordingly is then susceptible of low prices of sale to the consuming public, thereby making such pier system economically available to the buying public.

Even still another object of the present invention is to provide a pier system which is strong and easily assembled.

Lastly, it is an object of the present invention to provide a new and improved pier system having a plurality of footers each formed with a base fabricated of concrete with a top face having a downwardly extending bore. A plurality of pilings are each formed with a hollow tubular shaft with a top region and a bottom region coupled to a footer. Each piling has a reinforcing bar with an upper region and a lower region coupled within the bore of a footer. Each piling further has a plurality of apertures formed within the upper region of each shaft. A deck has a plurality of stringers with spaced free ends located within the shafts. A supplemental quantity of concrete within each shaft couples the shafts, footers, reinforcing bars, and stringers. A plurality of planks have mechanisms that couple the planks to the stringers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration Is given to the following detailed description thereof. Such description makes reference to the annexed drawings wherein:

FIGS. 4A and 4B are illustrations of the lower extent of the piling and footer taken at various stages of fabrication.

FIG. 4C is an alternate embodiment of the lower extent of the piling and footer in accordance with an alternate embodiment of the invention.

FIG. 5 is a cross sectional view taken along Line 5—5 of FIG. 2.

FIG. 6 is a cross sectional view taken along Line 6—6 of FIG. 2.

FIG. 7 is an enlarged showing, partly in cross section, taken at Circle 7 of FIG. 2.

FIG. 8 is a cross sectional view taken along Line 8—8 of FIG. 7.

FIG. 9 is an enlarged showing, partially in cross section, taken at Circle 9 of FIG. 2.

FIG. 9A shows an alternate embodiment of the invention.

FIG. 10 is a cross sectional view taken along Line 10—10 of FIG. 9.

The same reference numerals refer to the same parts throughout the various Figures.

DESCRIPTION OF THE PREFERRED EMBODIMENT

Figure 1:
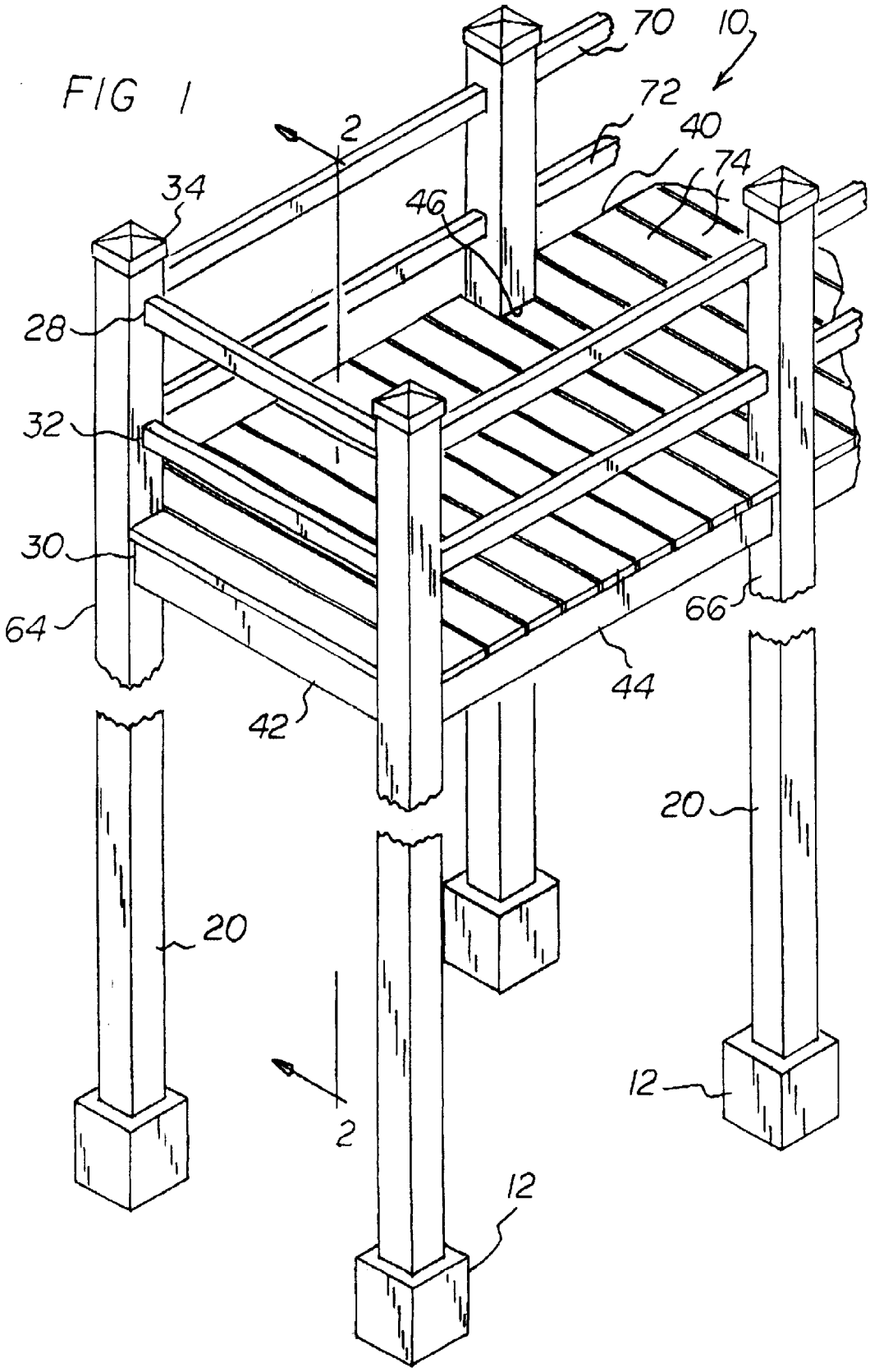
FIG. 1 is a perspective view of the new and improved pier system constructed in accordance with the principles of the present invention.
Figure 2:
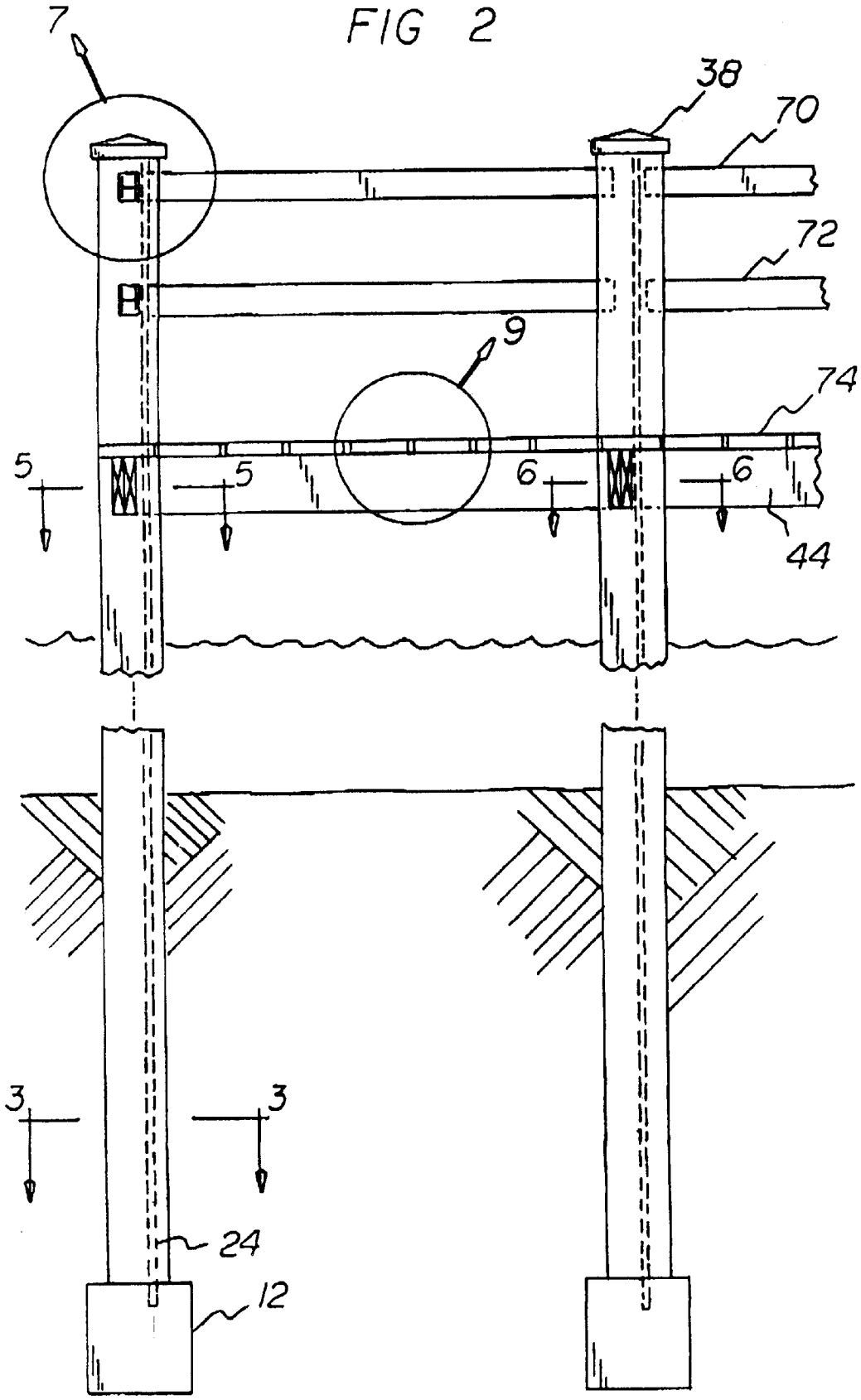
FIG. 2 is a side elevational view of the pier shown in FIG. 1.
Figure 3:
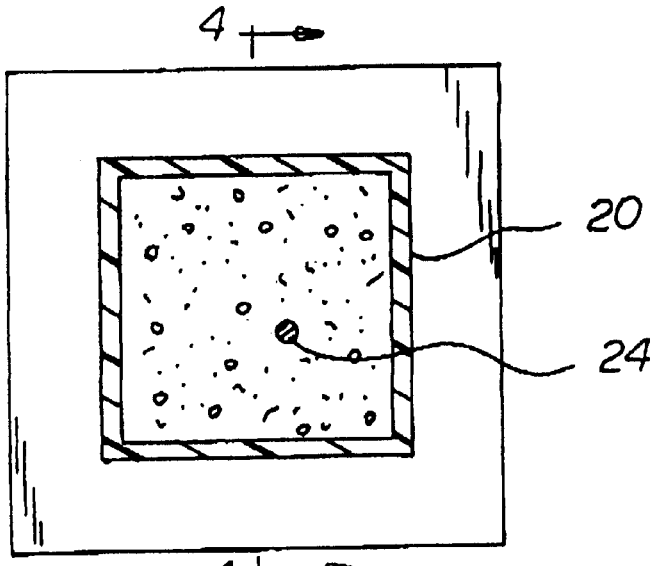
FIG. 3 is a cross sectional view taken along Line 3—3 of FIG. 2.

With reference now to the drawings, and in particular to FIG. 1 thereof, the preferred embodiment of the new and improved pier system embodying the principles and concepts of the present invention and generally designated by the reference numeral 10 will be described.

The present invention, the pier system 10 is comprised of a plurality of components. Such components in their broadest context include a plurality of footers, a plurality of pilings, a deck, a supplemental quantity of concrete, and a plurality of planks. Such components are individually configured and correlated with respect to each other so as to attain the desired objective.

Figure 4:
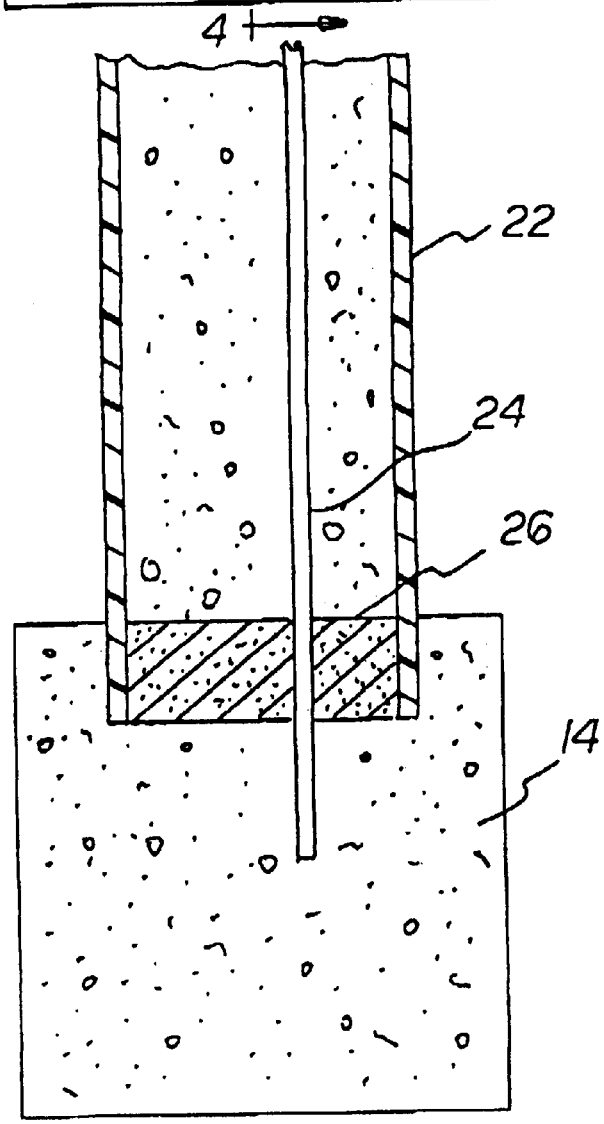
FIG. 4 is a cross sectional view taken along Line 4—4 of FIG. 3.

First provided are a plurality of footers 12. The footers are fabricated at an off site location. Each footer is formed of a base 14 fabricated of concrete. The base has a generally cubical configuration with a top face and a square bottom face and four square side faces there between. Each top face has a rectilinear recess 16 with a downwardly extending cylindrical bore 18 therein. FIG. 4A shows a footer being fabricated with an external form and an internal form for creating the recess. FIG. 4B adds a drilled bore and represents the footer for being shipped to a construction site.

Next provided are a plurality of pilings 20. The pilings include corner pilings and side pilings. Each piling is formed of a hollow tubular shaft 22 fabricated of polyvinyl chloride in a square cross sectional configuration with a top region and bottom region. Each shaft has dimensions such that the lower region is matingly received and coupled within the recess of a footer. Each piling further has a reinforcing bar 24 with an upper region and a lower region. The upper region of the reinforcing bar extends into the upper region of the shaft. The lower region of the reinforcing bar is received and coupled within the bore of the footer. At the construction site, a quantity of a two part epoxy resin 26 is applied within the recess to couple the shaft and reinforcing bar to the footer. Each piling further has a plurality of apertures at various heights within the upper region of the shaft. The apertures include upper apertures 28, lower apertures 30 and intermediate apertures 32.

A cap 34 is next provided. The cap is fabricated of polyvinyl chloride. The cap is coupled to and covers the upper extent of each shaft following the pouring of concrete at the construction site. Each cap has a square bottom region 36 with dimensions greater than the shaft. This configuration enables the cap to fit snugly around and over the shaft. The cap further has a pyramid-shaped upper portion 38.

A deck 40 comprises a plurality of stringers. The stringers include end stringers 42 and side stringers 44 and intermediate stringers 46. Each stringer Is formed of two hollow polyvinyl chloride beams 48. Each beam has a rectangular cross section with a top face 50 and a parallel bottom face. Each beam also has an inside face 52 and a parallel outside face 54 between the top face and bottom face. Each beam has a support rod 56 there within with an H-shaped cross section. All of the beams have spaced free ends 58. Each stringer is formed of a pair of beams adjacent to each other to form a flush top support surface 60. Nut and bolt assemblies 62 are located within the shafts. The nut and bolt assemblies couple together the beams of each stringer and extend through the side faces of adjacent beams. The end stringers and side stringers meet at adjacent ends within a corner piling 64 through lower apertures at right angles with respect to each other. The side stringers meet at adjacent ends within side pilings 66 and corner pilings through lower apertures in a linear relationship with respect to each other. The intermediate stringers extend between side pilings through lower apertures at right angles to the side stringers.

The deck further Includes a plurality of top rails 70. Each top rail is formed of a hollow rectangular polyvinyl chloride beam. A support rod is provided inside each beam. The support rod has an H-shaped cross section and is also formed of polyvinyl chloride. Each top rail is adapted to couple to two adjacent pilings through upper apertures in the piling above the stringers.

The deck further includes a plurality of top rails 70. Each top rail is formed of a hollow rectangular polyvinyl chloride beam. A support rod is provided inside each beam of the top rails. The support rod has an H-shaped cross section and is also formed of polyvinyl chloride. Each top rail is adapted to couple to two adjacent pilings through upper apertures in the piling above the stringers.

A supplemental quantity of concrete is provided. The concrete fills each shaft from the top of the epoxy resin to the top of the shaft to hold together the shafts, footers, reinforcing bars, stringers and rails.

The deck further includes a plurality of planks 74. The planks are formed of hollow rectangular polyvinyl chloride beams. Each beam has a top face 76, a bottom face, a pair of side faces and a pair of opposite ends. The top face has a plurality of linear grooves 78 in a crossing pattern. The grooves function to precipitate the drainage of water and provide a slip abating walking surface. Lateral grooves 80 extend along the entire length of each side face for coupling purposes.

Next provided are a plurality of coupling mechanisms 82. Each coupling mechanism is formed of a pin with a top portion 84 and a bottom portion 86. The too portion has a head adjacent thereto. The bottom portion is positioned on a stringer with a screw 88 driven there through Into a stringer. Each coupling mechanism is rotatable. The top region has a pair of enlarged peripheries 90 extending radially therefrom. Each coupling mechanism is adapted to being driven into a stringer whereby planks can be laid there between and the coupling mechanisms rotated such that the peripheries extend into the grooves of the adjacent planks for securement purposes.

An alternate embodiment of the invention is shown in FIG. 4C. In this embodiment, each footer is formed of the base 92 having a generally cubical configuration. The recess and epoxy resin of the primary embodiment are eliminated. The base has a square top face and a square bottom face. The base also has four side faces between the top face and bottom face. The base is formed of concrete. Further, in this embodiment each footer has a horizontal support bar 94 at an intermediate height. A short reinforcing bar 96 is provided. The short reinforcing bar has an upper portion extending above the concrete. The short reinforcing bar also has a lower portion with a semicircular hook 98. The hook receives the horizontal support bar. The footer also includes a tubular short sleeve 100. The short sleeve has a lower end within the concrete and an upper end above the concrete. The sleeve has a length above the concrete essentially equal to the length of the short reinforcing bar so that the upper end of the short reinforcing bar is not exposed accidents are thus avoided. Such footer is fabricated off site with the long sleeve and long reinforcing bar added at the construction site.

A final alternate embodiment of the invention is shown in FIG. 9A. In this embodiment, the stringers and planks 102 are fabricated of wood rather than of a plastic material as in the primary embodiment. Coupling between the planks and stingers is preferably by nails.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in he specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pier system comprising:

a plurality of footers each formed with a base fabricated of concrete with a top face having a downwardly extending bore;

a plurality of pilings each formed with a hollow tubular shaft with a top region and bottom region coupled to one of the footers, each piling also having a reinforcing bar with an upper region and a lower region coupled within the bore of one of the footers, each piling further having a plurality of apertures formed within the top region of each shaft;

a deck comprising a plurality of stringers having spaced free ends located within the shafts;

a supplemental quantity of concrete within each shaft coupling the shafts, footers, reinforcing bars, and stringers; and a plurality of planks with mechanisms coupling the planks to the stringers.

2. The system as set forth in claim 1 wherein each footer is fabricated at an off site location, the footer having a generally cubical configuration with a top face as set forth in claim 1 and a square bottom face and four square side faces there between, each top face having a rectilinear recess receiving the bottom of the shaft and with a downwardly extending cylindrical bore as described in claim 1 therein receiving the bottom of the reinforcing bar and with a two part epoxy resin filling the recess to couple the shaft and reinforcing bar and footer.

3. The system as set forth in claim 1 wherein the deck includes a plurality of rails with free ends received within the apertures above the stringers.

4. The system as set forth in claim 1 wherein the stringers and planks are fabricated of plastic.

5. The system as set forth in claim 1 wherein the stringers and planks are fabricated of wood.

6. A piling footer fabricated of concrete having a top face formed with a downwardly extending bore, the footer including a hollow tubular shaft with a top region and a bottom region coupled to the concrete footer, the footer also including a reinforcing bar with an upper region and a lower region wherein the lower region of the reinforcing bar is coupled within the bore of the footer and wherein the footer having a base having a generally cubical configuration with a square bottom face and four square side faces there between, each top face having a rectilinear recess receiving the bottom of the shaft and with the downwardly extending cylindrical bore therein receiving the bottom of the reinforcing bar and with a two part epoxy resin filling the recess to couple the shaft and reinforcing bar and footer.

* * * * *